US012320115B2

(12) United States Patent
Baltz, Jr. et al.

(10) Patent No.: US 12,320,115 B2
(45) Date of Patent: Jun. 3, 2025

(54) TOP OF WALL VENTILATION SCREED DEVICE AND ASSEMBLY

(71) Applicant: Alabama Metal Industries Corporation, Birmingham, AL (US)

(72) Inventors: Gary George Baltz, Jr., Mountain Brook, AL (US); Frederic C. Mayer, Jr., Hoover, AL (US)

(73) Assignee: Alabama Metal Industries Corporation, Birmingham, AL (US)

( * ) Notice: Subject to any disclaimer, the term of this patent is extended or adjusted under 35 U.S.C. 154(b) by 816 days.

(21) Appl. No.: 17/455,723

(22) Filed: Nov. 19, 2021

(65) Prior Publication Data

US 2022/0074196 A1 Mar. 10, 2022

Related U.S. Application Data

(63) Continuation of application No. 16/194,718, filed on Nov. 19, 2018, now Pat. No. 11,180,913.

(60) Provisional application No. 62/592,614, filed on Nov. 30, 2017.

(51) Int. Cl.

| | |
|---|---|
| ***E04B 1/70*** | (2006.01) |
| ***E04D 13/152*** | (2006.01) |
| ***E04F 13/00*** | (2006.01) |
| ***E04F 13/06*** | (2006.01) |
| *F24F 7/10* | (2006.01) |

(52) U.S. Cl.

CPC ..... *E04B 1/7076* (2013.01); *E04F 13/007* (2013.01); *E04F 13/068* (2013.01); *E04D 13/152* (2013.01); *F24F 7/10* (2013.01)

(58) Field of Classification Search

CPC ..... F24F 7/10; E04D 13/152; E04F 13/068; E04F 13/007; E04B 1/7076

USPC ..... 454/276

See application file for complete search history.

(56) References Cited

U.S. PATENT DOCUMENTS

| | | | | |
|---|---|---|---|---|
| 1,676,582 | A * | 7/1928 | Stuart | E04F 13/06 52/27 |
| 2,245,965 | A | 6/1941 | Hyman | |
| D151,022 | S | 9/1948 | Weber et al. | |
| D164,420 | S | 9/1951 | Hodgman | |

(Continued)

FOREIGN PATENT DOCUMENTS

| | | | |
|---|---|---|---|
| AU | 2008202082 | A1 | 11/2008 |
| CA | 2777166 | C | 8/2019 |

(Continued)

*Primary Examiner* — Allen R. B. Schult

(74) *Attorney, Agent, or Firm* — HONIGMAN LLP

(57) ABSTRACT

A ventilation screed configured to be mounted at a vertical wall of a structure includes an attachment flange having an upper end region and a lower end region opposite the upper end region. A cavity structure is disposed along the upper end region of the attachment flange. The cavity structure has a first side, a second side, and a third side. The first side extends from the upper end region of the attachment flange. The third side extends over the first side and is spaced from the first side and from the upper end region of the attachment flange. The second side extends between the first side and the third side. At least one ventilation opening is formed through the first side of the cavity structure. A ventilation spacer extends from the first side of the cavity structure and is spaced from and extends partially along the attachment flange.

29 Claims, 13 Drawing Sheets

(56) References Cited

U.S. PATENT DOCUMENTS

| | | | | |
|---|---|---|---|---|
| D164,421 | S | 9/1951 | Hodgman | |
| 2,645,824 | A | 7/1953 | Titsworth | |
| 2,664,057 | A | 12/1953 | Ausland | |
| 3,206,806 | A | 9/1965 | Powell | |
| 3,343,323 | A | 9/1967 | Mayfield | |
| 3,568,391 | A | 3/1971 | Conway | |
| D249,164 | S | 8/1978 | Grant | |
| 4,924,547 | A | 5/1990 | Wachtel et al. | |
| 4,924,647 | A | 5/1990 | Drucker | |
| 5,423,154 | A | 6/1995 | Maylon et al. | |
| 5,579,617 | A | 12/1996 | Schiedegger | |
| 5,630,297 | A | 5/1997 | Rutherford | |
| 5,694,723 | A | 12/1997 | Parker | |
| 5,699,638 | A | 12/1997 | Maylon | |
| 5,809,731 | A | 9/1998 | Reiss | |
| 5,836,135 | A | 11/1998 | Hagan et al. | |
| 6,018,924 | A | 2/2000 | Tamlyn | |
| 6,119,429 | A | 9/2000 | Bifano | |
| 6,293,064 | B1 | 9/2001 | Larson | |
| 6,298,609 | B1 | 10/2001 | Bifano | |
| 6,308,470 | B1 | 10/2001 | Durkovic | |
| 6,385,932 | B1 | 5/2002 | Melchiori | |
| D459,007 | S | 6/2002 | Campacci | |
| 6,410,118 | B1 | 6/2002 | Reicherts | |
| 6,470,638 | B1 | 10/2002 | Larson | |
| D471,991 | S | 3/2003 | Maylon et al. | |
| D477,420 | S | 7/2003 | Butcher | |
| 6,792,725 | B1 | 9/2004 | Rutherford | |
| 6,823,633 | B2 | 11/2004 | Ryan | |
| 6,988,345 | B1 | 1/2006 | Pelfrey | |
| 7,219,477 | B2 | 5/2007 | Leffler | |
| 7,487,623 | B2 | 2/2009 | Rodolofo | |
| 7,546,719 | B1 | 6/2009 | Guevara | |
| 7,584,587 | B2 | 9/2009 | Ouellette | |
| 7,621,079 | B2 | 11/2009 | Kyozaburo | |
| 7,634,883 | B1 | 12/2009 | Larson | |
| 7,673,421 | B2 * | 3/2010 | Pilz | E04F 13/06 52/60 |
| D618,825 | S | 6/2010 | Johnson | |
| 7,743,575 | B2 | 6/2010 | Ito | |
| D624,212 | S | 9/2010 | Sawyer | |
| 7,810,291 | B2 | 10/2010 | McPherson | |
| 8,281,530 | B2 | 10/2012 | Chaussee | |
| 8,578,660 | B2 | 11/2013 | Nolan | |
| 8,584,416 | B2 | 11/2013 | Chenier | |
| 8,596,019 | B2 | 12/2013 | Aitken | |
| 8,646,222 | B2 | 2/2014 | Carbonaro | |
| D700,717 | S | 3/2014 | Campacci | |
| D703,306 | S | 4/2014 | Little | |
| D703,307 | S | 4/2014 | Little | |
| 8,726,594 | B2 | 5/2014 | Salazar | |
| 8,813,443 | B2 | 8/2014 | Goldberg | |
| 8,919,062 | B1 | 12/2014 | Viness | |
| 8,943,761 | B2 | 2/2015 | Carbonaro | |
| 9,140,008 | B2 | 9/2015 | Fischer | |
| D740,968 | S | 10/2015 | Stanfill | |
| 9,366,040 | B2 | 6/2016 | Singh | |
| D761,971 | S | 7/2016 | Apanovich et al. | |
| D762,310 | S | 7/2016 | Apanovich | |
| D787,091 | S | 5/2017 | Singh | |
| D792,609 | S | 7/2017 | Smith et al. | |
| D800,344 | S | 10/2017 | Apanovich | |
| D800,921 | S | 10/2017 | Apanovich | |
| D814,057 | S | 3/2018 | Singh | |
| D815,757 | S | 4/2018 | Braun | |
| D817,518 | S | 5/2018 | Singh | |
| 10,024,063 | B2 | 7/2018 | Friel | |
| D842,496 | S | 3/2019 | Apanovich | |
| 10,494,818 | B2 * | 12/2019 | Maziarz | E06B 7/2303 |
| D888,285 | S | 6/2020 | Baltz, Jr. et al. | |
| D893,051 | S | 8/2020 | Baltz, Jr. et al. | |
| 10,731,335 | B2 * | 8/2020 | Baltz, Jr. | E04B 1/7038 |
| D896,993 | S | 9/2020 | Baltz, Jr. et al. | |
| D902,443 | S | 11/2020 | Baltz, Jr. | |
| D903,146 | S | 11/2020 | Baltz, Jr. et al. | |
| D904,649 | S | 12/2020 | Maldonado et al. | |
| 11,180,913 | B2 * | 11/2021 | Baltz, Jr. | E04F 13/007 |
| 2003/0126810 | A1 | 7/2003 | Brunson | |
| 2003/0177736 | A1 | 9/2003 | Gatherum | |
| 2005/0115189 | A1 | 6/2005 | Leffler | |
| 2006/0123723 | A1 | 6/2006 | Weir | |
| 2006/0199505 | A1 | 9/2006 | Fettkether | |
| 2006/0277854 | A1 | 12/2006 | Egan | |
| 2007/0044402 | A1 | 3/2007 | Hess | |
| 2007/0062137 | A1 * | 3/2007 | Maylon | E04F 13/06 52/367 |
| 2007/0130861 | A1 | 6/2007 | Chenier | |
| 2007/0256386 | A1 | 11/2007 | Ito | |
| 2008/0104918 | A1 | 5/2008 | Gleeson | |
| 2008/0148672 | A1 | 6/2008 | Monteer | |
| 2008/0220714 | A1 | 9/2008 | Caruso et al. | |
| 2008/0263971 | A1 | 10/2008 | Maziarz | |
| 2009/0173858 | A1 | 7/2009 | LaCerte | |
| 2009/0183453 | A1 * | 7/2009 | Koessler | E04F 13/007 52/302.3 |
| 2010/0101168 | A1 | 4/2010 | Hohmann | |
| 2010/0287861 | A1 | 11/2010 | Goldberg | |
| 2011/0252731 | A1 | 10/2011 | Boyer | |
| 2011/0302863 | A1 | 12/2011 | Sourlis | |
| 2012/0066984 | A1 | 3/2012 | Thompson | |
| 2012/0066986 | A1 | 3/2012 | Thompson | |
| 2013/0104481 | A1 | 5/2013 | Urban, Jr. et al. | |
| 2013/0125487 | A1 | 5/2013 | Power | |
| 2015/0013257 | A1 | 1/2015 | Power | |
| 2015/0027074 | A1 | 1/2015 | Preston | |
| 2016/0069071 | A1 | 3/2016 | Remmele | |
| 2016/0168869 | A1 | 6/2016 | Curtis et al. | |
| 2016/0340908 | A1 | 11/2016 | Apanovich | |
| 2017/0030072 | A1 | 2/2017 | Corson | |
| 2017/0226732 | A1 | 8/2017 | Collins | |
| 2017/0254091 | A1 | 9/2017 | Friel | |
| 2018/0112414 | A1 | 4/2018 | Maziarz | |
| 2018/0305921 | A1 | 10/2018 | Margalit | |
| 2019/0136549 | A1 | 5/2019 | Maziarz | |
| 2019/0161960 | A1 | 5/2019 | Baltz, Jr. | |
| 2019/0194954 | A1 | 6/2019 | Baltz, Jr. | |
| 2019/0292791 | A1 | 9/2019 | Friel | |
| 2019/0368190 | A1 | 12/2019 | Stender | |
| 2020/0063432 | A1 | 2/2020 | Baltz, Jr. | |
| 2020/0063446 | A1 | 2/2020 | Baltz, Jr. | |
| 2020/0157798 | A1 | 5/2020 | Baltz, Jr. et al. | |

FOREIGN PATENT DOCUMENTS

| | | | |
|---|---|---|---|
| CA | 2983532 | C | 3/2021 |
| JP | 06330571 | | 11/1994 |
| JP | 2657037 | | 9/1997 |
| JP | 10037321 | | 2/1998 |
| JP | 11131611 | | 5/1999 |
| JP | 2008196248 | A | 8/2008 |
| JP | 4490340 | | 6/2010 |
| JP | 2011169094 | A | 9/2011 |
| JP | 5002275 | B2 | 8/2012 |
| JP | 2012202177 | A | 10/2012 |
| JP | 2014218814 | A | 11/2014 |
| JP | 5968618 | B2 | 8/2016 |
| WO | 2016040273 | A1 | 3/2016 |

* cited by examiner (132)

(134)

(136)

TOP OF WALL VENTILATION SCREED DEVICE AND ASSEMBLY

CROSS REFERENCE TO RELATED APPLICATIONS

The present application is a continuation of U.S. patent application Ser. No. 16/194,718, filed Nov. 19, 2018, now U.S. Pat. No. 11,180,913, which claims the filing benefits of U.S. provisional application Ser. No. 62/592,614, filed Nov. 30, 2017.

TECHNICAL FIELD

The present disclosure generally relates to a device configured to allow ventilation and the escape of water or other moisture, typically in the form of vapor at the top of abuilding or wall structure.

BACKGROUND

For purposes of the foregoing specification and appended claims the term "vapor," whether or not accompanied by any words such as "moisture," "water" or other words describing similar matter or states of matter, refers to all forms of liquid and gases not limited to water, water vapor, moisture as created by any means.

This invention addresses the condition that walls hold vapor and moisture and their inability to allow vapor and moisture to escape so the wall can dry is a major factor in the premature deterioration of a structure. Building science, construction practices and emerging energy codes have changed greatly over recent decades resulting in significantly better insulated walls. Consequently these newer wall designs allow less means for vapor and moisture to escape and less air flow. This has led to increasingly premature deterioration of walls of buildings and structures.

Established wall designs and construction are intended to keep water out of walls but not necessarily to allow them to breathe. Building wraps traditionally prevent water intrusion but do not let moisture out. A better wall design must allow for moisture and vapor to move through a predetermined path depending upon when the inside and outside temperatures have the sufficient temperature difference to create and hold excess moisture.

Further, air pressure differential from inside and outside the wall due to temperature and or wind can force moisture into the wall through the wall's surface, in addition preventing vapor and moisture from escaping. This prevents condensation from escaping and inhibits drying. Further, when cold air contacts hot air, or vice versa, condensation occurs and moisture is formed inside the walls of buildings and structures.

As a result, moisture and water accumulates without a means to escape causing the sheathing of walls to absorb moisture. Plywood, cement board, or OSB (Oriented Strand Board), which is more prone to absorb moisture can begin to mold, deteriorate, rot and hold more water. As the sheathing fails the weight of the finish material will begin to crack. This allows more moisture accumulation in the walls. Ultimately the finish material can fall away from the building or structure. Areas receiving 20-inches or more of rain a year are the most susceptible to this type of deterioration.

Designs currently available only use casing beads for the top of walls of a structure or a building. The current art does not facilitate the ventilation of a primary drainage cavity or the drying of the inside of the wall. Some of these areas of concern are at the top of full height walls and step walls, changes in roofline where a vertical element terminates into a non-vertical structure such as a dormer and roof for the removal of vapor from the top of the wall. In areas as noted above where greater rainfall is typical a more defined escape means for vapor and moisture is required over current methods.

Current commercially available accessories for stucco, stone and other finishes do not address these conditions and constraints on air and vapor flow throughout a wall. Therefore a new wall design and trim accessories are necessary to accommodate the different forms and function of the building envelope and prevent premature deterioration of the walls.

SUMMARY OF THE INVENTION

In one embodiment, a ventilation screed is provided comprising: a perforated attachment flange portion that is substantially vertical and has a top end and a bottom end and at least one perforation between the top end and the bottom end; a three sided cavity portion having a first side that is substantially horizontal having a left portion and a right portion, a second side that is substantially vertical having a top portion and a bottom portion and the top portion is in communication with the left portion of the first side at a substantially 90 degree angle to the first side and a third side that is between the bottom portion of the second side and the top end of the perforated attachment flange portion at an angle that slopes downwardly from the top end of the perforated attachment flange to the bottom portion of the second side, wherein the third side has at least one ventilation opening; and a ventilation spacer along an underside of the third side of the three sided cavity portion.

In another embodiment, a ventilation screed assembly is provided, comprising: at least two ventilation screeds having a perforated attachment flange portion that is substantially vertical and has a top end and a bottom end and at least one perforation between the top end and the bottom end; a three sided cavity portion having a first side that is substantially horizontal having a left portion and a right portion, a second side that is substantially vertical having a top portion and a bottom portion and the top portion is in communication with the left portion of the first side at a substantially 90 degree angle to the first side and a third side that is between the bottom portion of the second side and the top end of the perforated attachment flange portion at an angle that slopes downward-ly from the top end of the perforated attachment flange to the bottom portion of the second side, wherein the third side has at least one ventilation opening; and a ventilation spacer along an underside of the third side of the three sided cavity portion; and a connector between two adjacent ventilation screeds.

BRIEF DESCRIPTION OF THE DRAWINGS

In the following section, the present disclosure will be described with reference to exemplary embodiments illustrated in the figures, in which.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other. It is noted that various figures (including component diagrams) shown and discussed herein are for illustrative purpose only, and are not drawn to scale.

Figure 1:
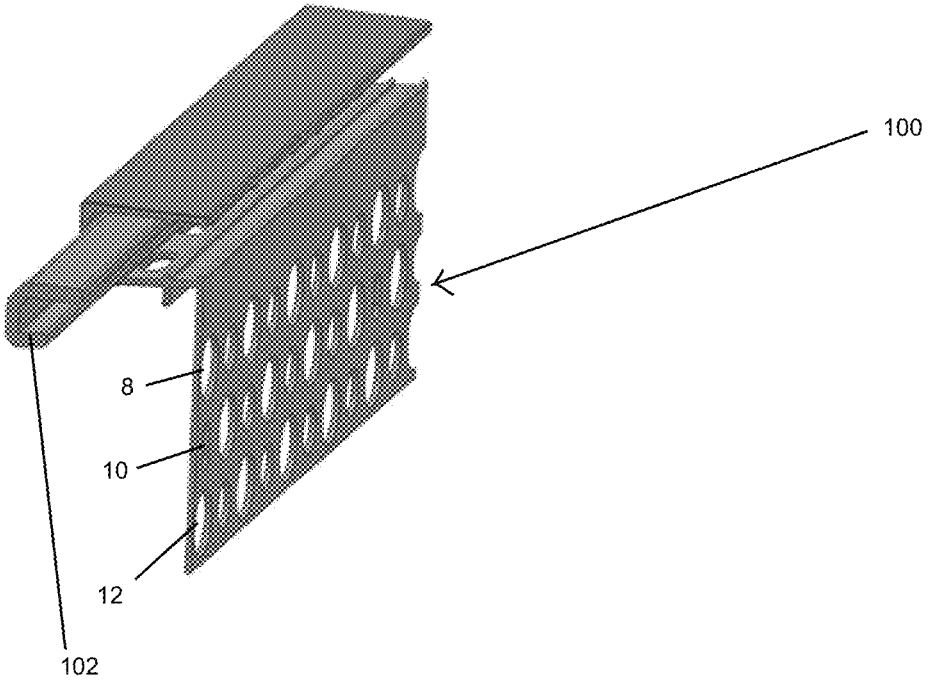
FIG. 1 depicts an isometric view of the present invention.
Figure 11:
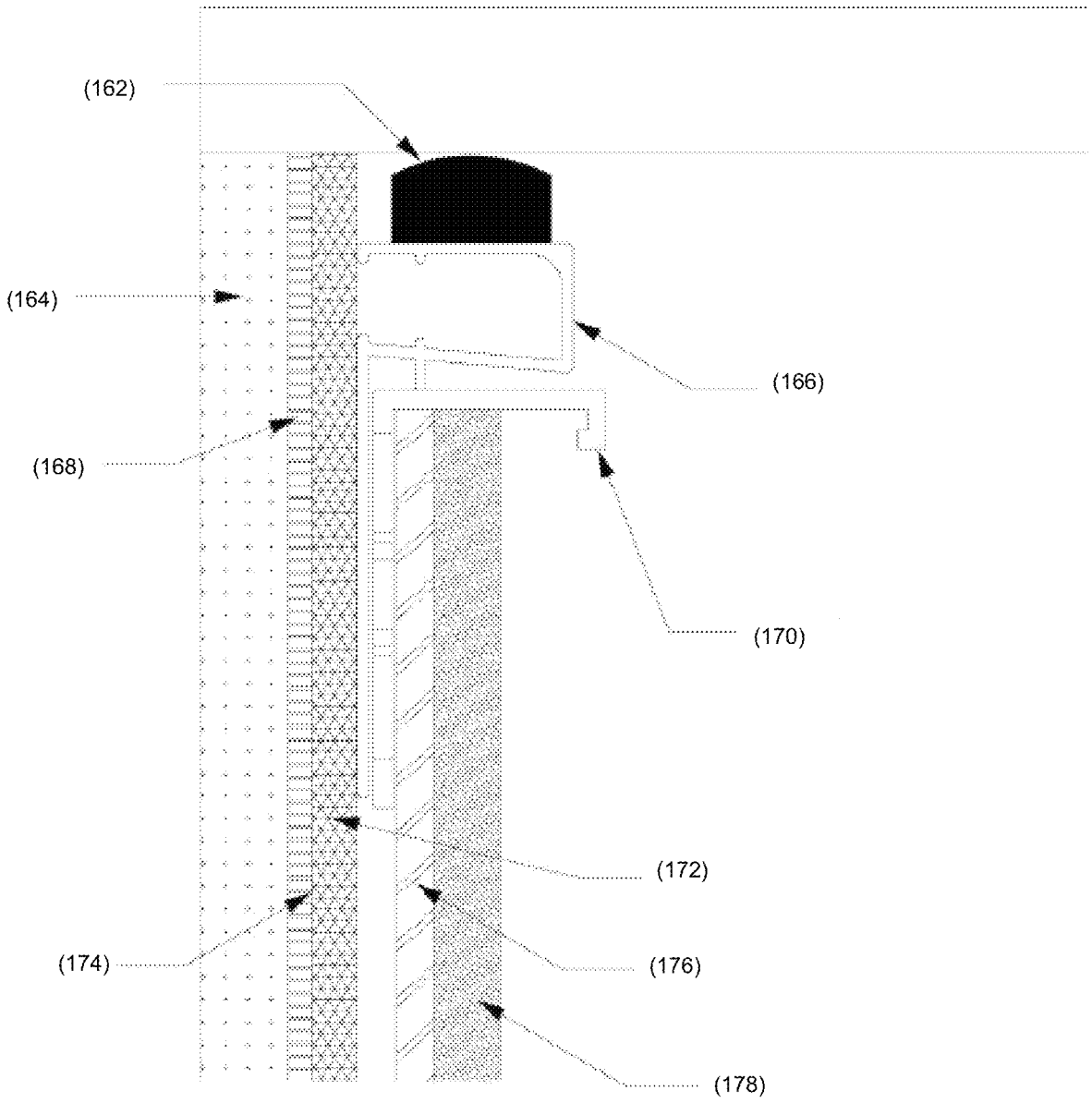
FIG. 11 depicts the present invention as installed.
Figure 12:
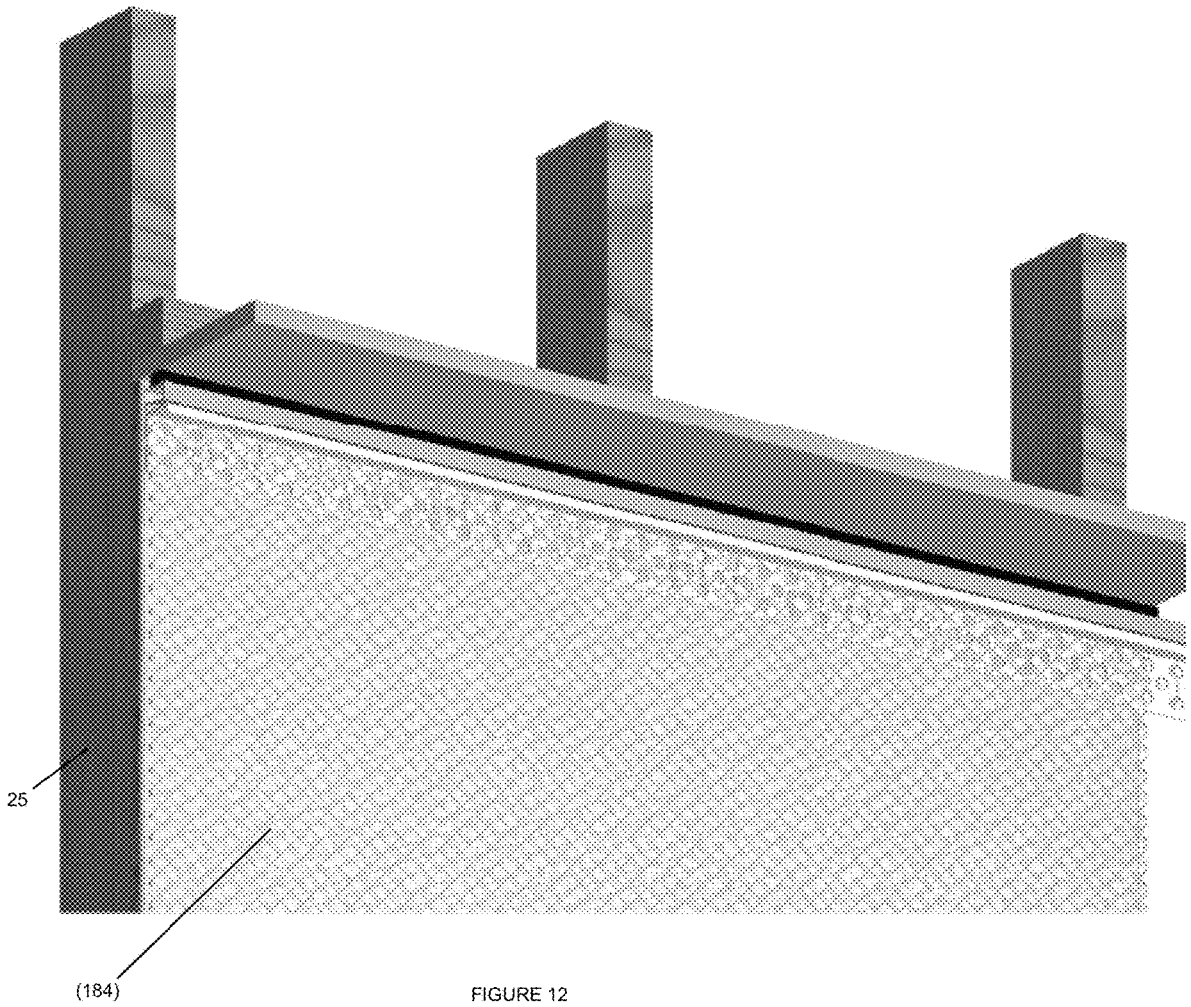
FIG. 12 depicts the present invention as installed.
Figure 13:
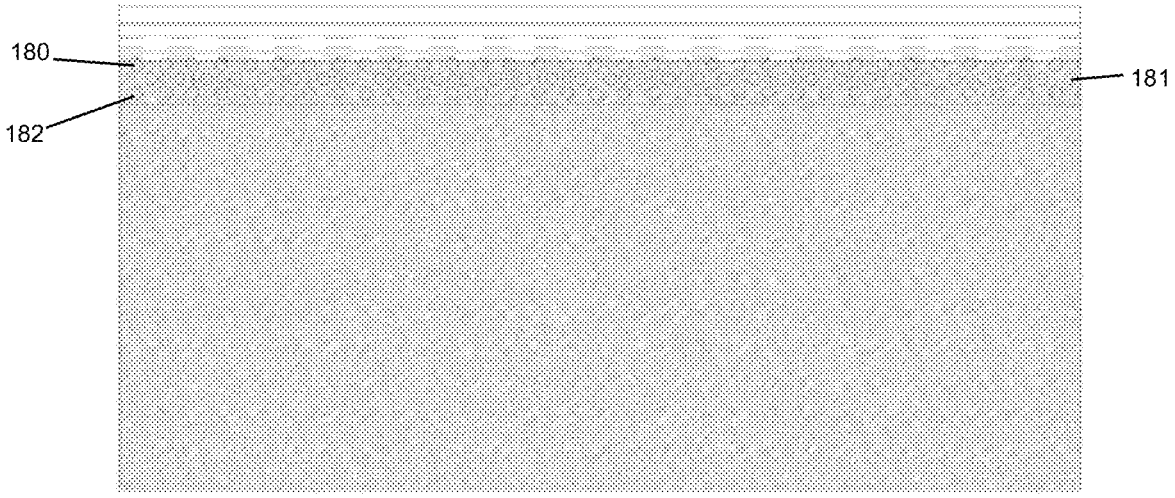
FIG. 13 depicts the present invention as installed.
Figure 14:
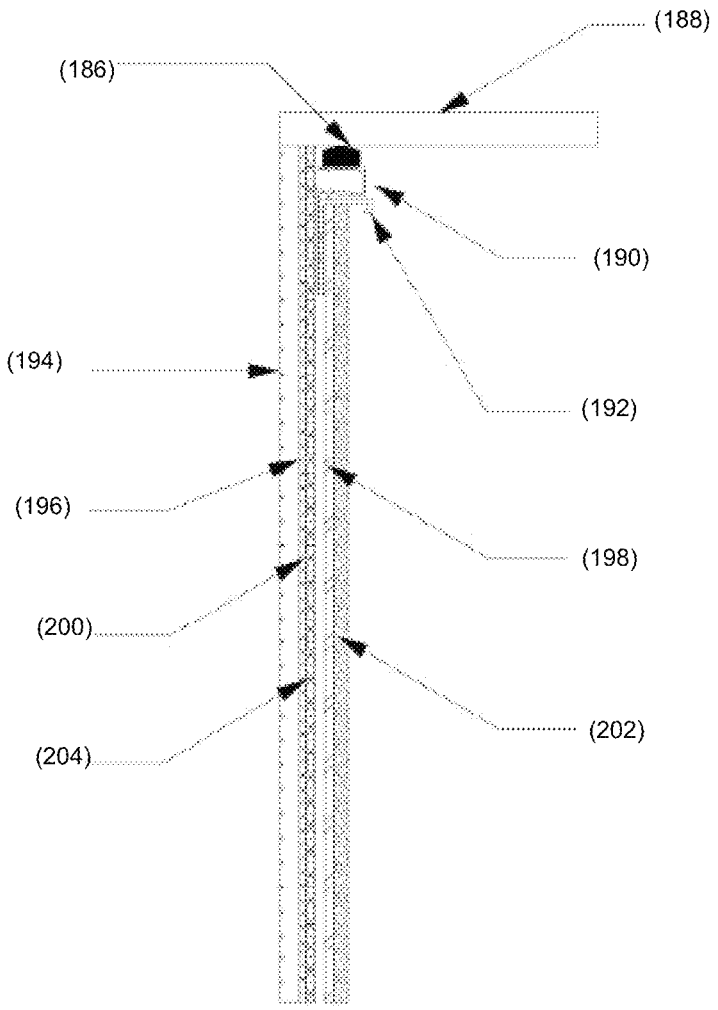
FIG. 14 depicts the present invention as installed.
Figure 15:
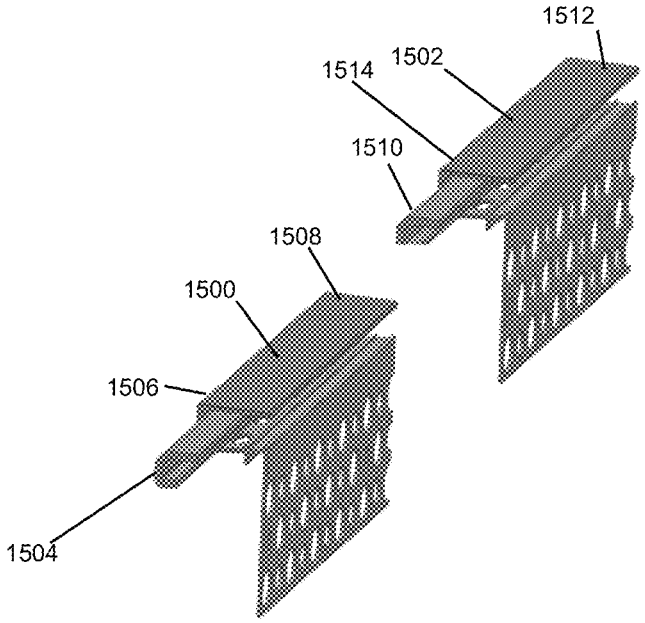
FIG. 15 depicts the present invention utilizing a joint connector.

Turning to FIGS. 1-14, the present invention is a ventilation screed (100) having: a perforated attachment flange portion (112) that is substantially vertical and has a top end (111) and a bottom end (113) and at least one perforation (185) between the top end (111) and the bottom end (113). The at least one perforation (185) of the perforated attachment flange portion may be three rows of circular openings (8, 10, 12). As depicted in FIG. 1, there may be a row of alternating larger openings and smaller openings and each row may be offset from the row below it. For example, as shown in FIGS. 1 and 12, a larger opening of one row (8) may be above a smaller opening of the row below it (10). The three sided cavity portion (106) has a first side (2) that is substantially horizontal having a left portion (101) and a right portion (99), a second side (4) that is substantially vertical having a top portion (103) and a bottom portion (105) and the top portion (103) is in communication with the left portion (101) of the first side (2) at a substantially 90 degree angle to the first side (2) and a third side (6) that is between the bottom portion (105) of the second side (4) and the top end (111) of the perforated attachment flange portion (112) at an angle that slopes downwardly from the top end (111) of the perforated attachment flange (112) to the bottom portion (105) of the second side (4), wherein the third side (6) has at least one ventilation opening (108); and a ventilation spacer (110) along an underside of the third side (6) of the three sided cavity portion. A portion of the ventilation spacer (110) and a portion of the perforated attachment flange portion (112) are in communication with a casing bead (128). It is noted that the casing bead (128) is not part of the invention, but the ventilation screed as installed is in communication with it. There may be a joint connector at a connection of at least one of the first side and the second side, the second side and the third side and the third side and the perforated attachment flange portion. FIG. 15 depicts an example of two side by side ventilation screeds (1500 and 1502) with two joint connectors (1504 and 1510). As can be seen the first joint connector (1504) sits in the drainage cavity along the left side (1506) of ventilation screen (1500). The second joint connector (1510), once connected, would sit in the right side (1508) of the ventilation screen (1500). In this way, the second ventilation screed (1502) would be connected to the first ventilation screed (1500). FIG. 15 depicts an exploded unconnected view of the two side by side ventilation screeds. As can be seen the joint connector in this example is J-shaped. This allows for stability while not blocking the ventilation openings. As can be seen, multiple joint connectors are used between adjacent ventilation screeds to line them up and provide additional stability.

There may be a connector (102) between two adjacent ventilation screeds (100). FIG. 1 depicts a single ventilation screed, a person of ordinary skill in the art would understand another ventilation screed is placed adjacent to the ventilation screed (100) shown and the connector would sit in the drainage cavity (106) of two adjacent ventilation screeds to facilitate straight, true and continuous installation of the invention. The connector (102) is a three sided connector that is smaller than the three sided cavity portion (106) and sits in the three sided cavity portion (106) to connect a first ventilation screed (100) to a second adjacent ventilation screed (not shown, would be identical to the first ventilation screed (100) to the left of it. The connector (102) sits between the two adjacent ventilation screeds.

There may be a moisture seal (e.g., 132, 134, 136, 138) attached to the left portion (101) of the first side (2) along a top portion of the first side. There may also be a screen (184) parallel to at least a portion of the perforated attachment flange portion (112). FIGS. 11-14 depict the ventilation screed (190) as installed. As shown in FIG. 11, a gasket (162) is under a soffit, the ventilation screed (190) is under the gasket (162) and above a casing bead (170). The environment as installed has sheathing (164), building wrap (168), reticulated foam or "greenscreen" (172), grade D paper (174), lath (176) and stucco or siding (178). The insect screen (106) could be reticulated foam, it could be an unwoven polymer such as cellulose, nylon or spun polypropylene fiber, or it could be even a nylon or polypropylene screen, although that would be less durable. There may be "Green Screen™", or another rain screen or solid or corrugated furring strips to the right of the ventilation screed (190), then lath and brick or stone veneer. The "Green Screen™", or another rain screen or solid or corrugated furring strips may be installed parallel to and between siding and the perforated attachment flange portion (112). There may also be a screen (184) vertical and perpendicular to at least a portion of the perforated attachment flange portion (112). There may also, or alternatively, be a mesh vertical and perpendicular to at least a portion of the perforated attachment flange portion. There may also be reticulated foam (which may be in the same location as the rain screen or solid or corrugated furring strips (112)) to the right of the ventilation screed, then lath and brick or stone veneer. The reticulated foam insert may be installed parallel to the siding. The term "greenscreen" refers to a polypropylene entangled mesh, but it could also be described as a polymer strand matrix with a dimple structure. The Greenscreen™ provides a drainage path and ventilation for moisture between the exterior wall finish and sheathing. It is a polymer strand matrix with a unique dimple design that exhibits superior compressive strength. When installed according to the present invention is allows over 99% of moisture and vapor to drain and escape from the wall. There may also be a screen parallel to at least a portion of the perforated attachment flange portion. There may also, or alternatively, be a mesh parallel to at least a portion of the perforated attachment flange portion. A shown, in FIG. 14, there may be a ventilation screed (190) with a moisture seal that is a gasket (186) between the ventilation screed (190) and a soffit (188) of a building. The optional "gasket" is provided to assist in getting a superior, and depending on the design of the gasket moveable, moisture barrier at the juncture of vertical and horizontal surfaces such as a soffit, or between the finish and a window or door jamb or whatever through wall penetration is required, such as but not limited to hose bib or louvered vent or vent shroud. The ventilation screed (190) is in communication with a casing bead (192). The building may have sheathing (194), building wrap (196), grade D paper (200) and a reticulated foam insert (204) that may be a "greenscreen." There may be lath (198) and stucco or siding (200). A screen (184) or mesh may be under the lath (198). The reticulated foam insert (204), as installed, may be parallel to and between a wall (25) and the perforated attachment flange portion (112).

Figure 2:
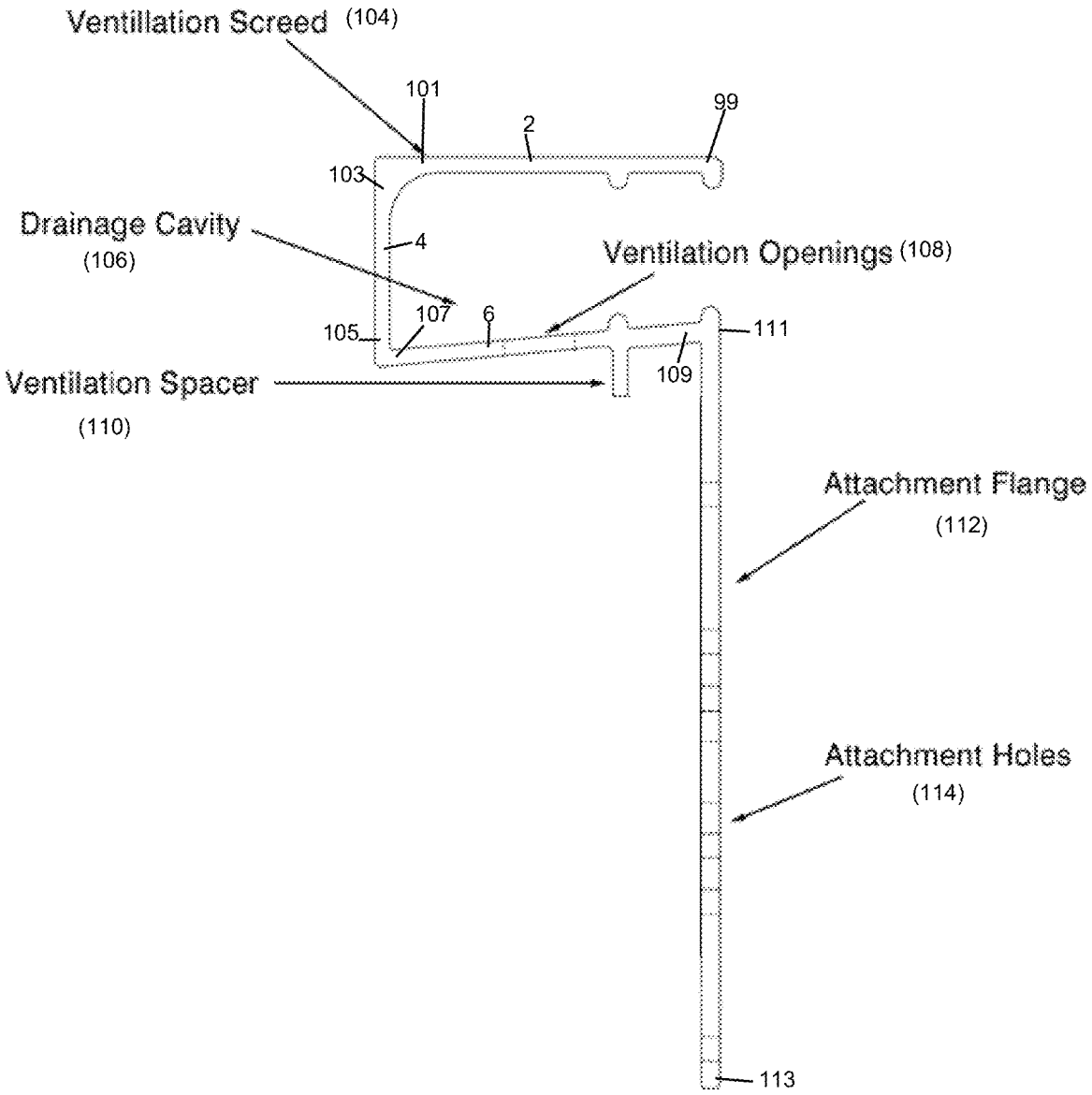
FIG. 2 depicts a side view of the present invention with labeling.
Figure 3:
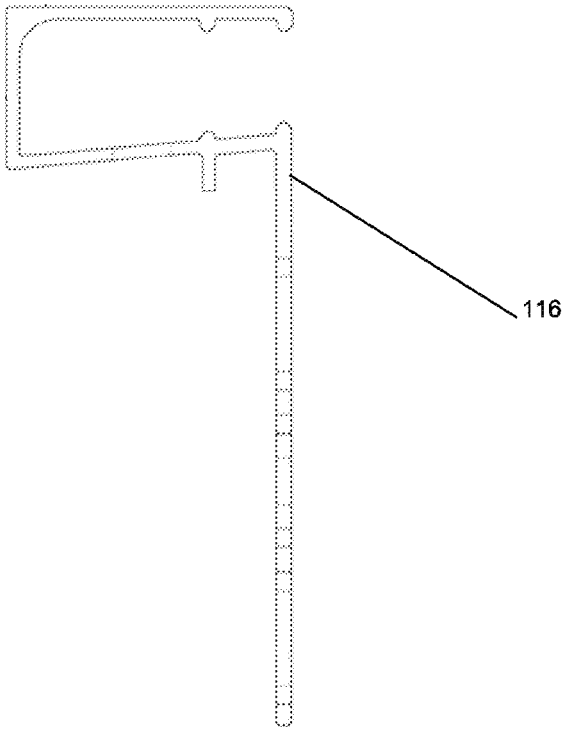
FIG. 3 depicts a side view of the present invention without labels.
Figure 4:
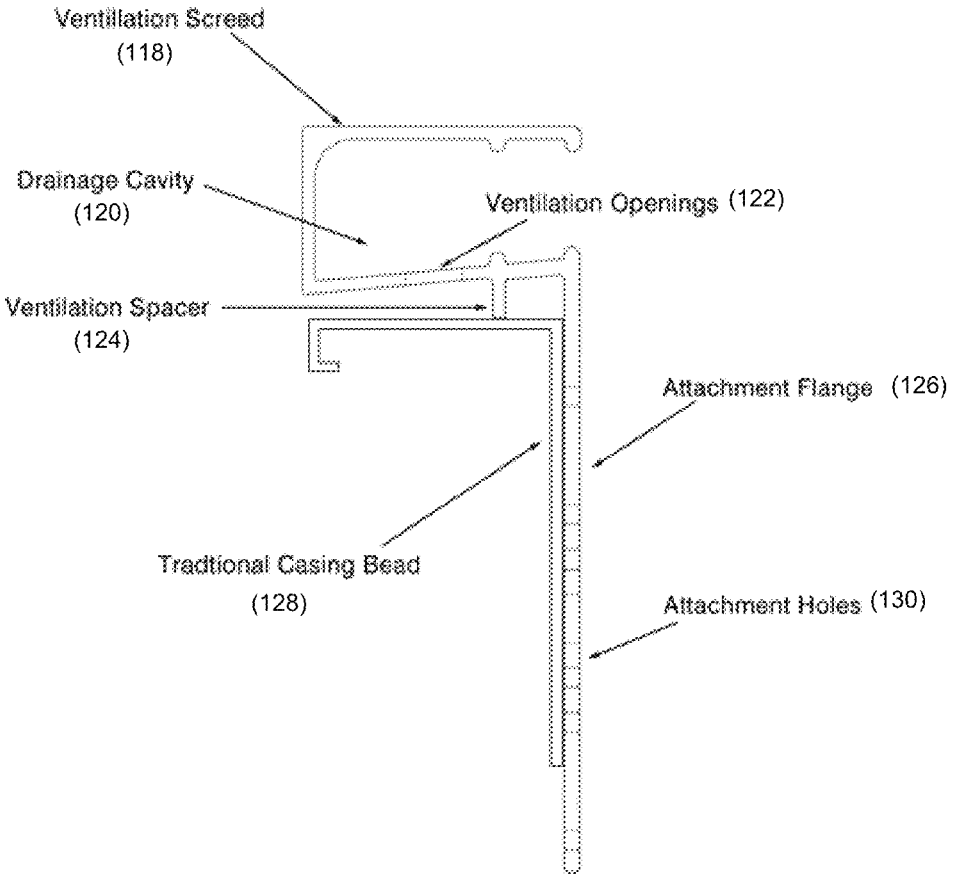
FIG. 4 depicts a side view of the present invention shown with nested, standard casing bead and labeled.
Figure 5:
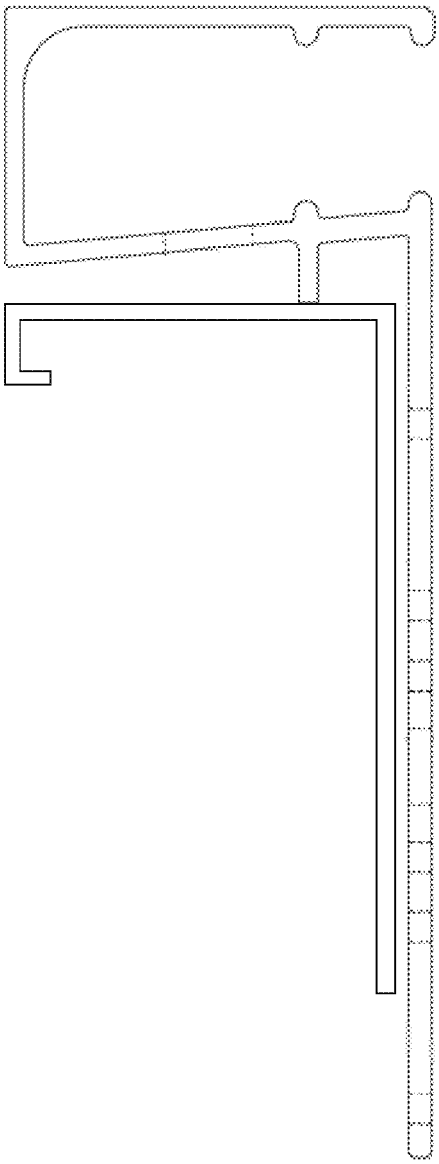
FIG. 5 depicts a side view of the present invention shown with nested, standard casing bead without labels.
Figure 6:
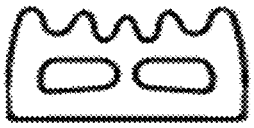
FIG. 6 depicts examples of water seals according to the present invention.
Figure 6:
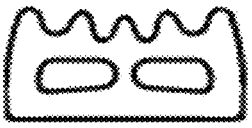
Figure 6:
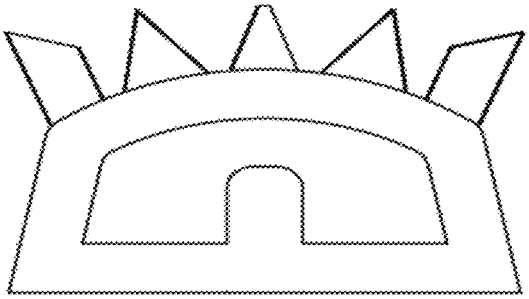
Figure 7:
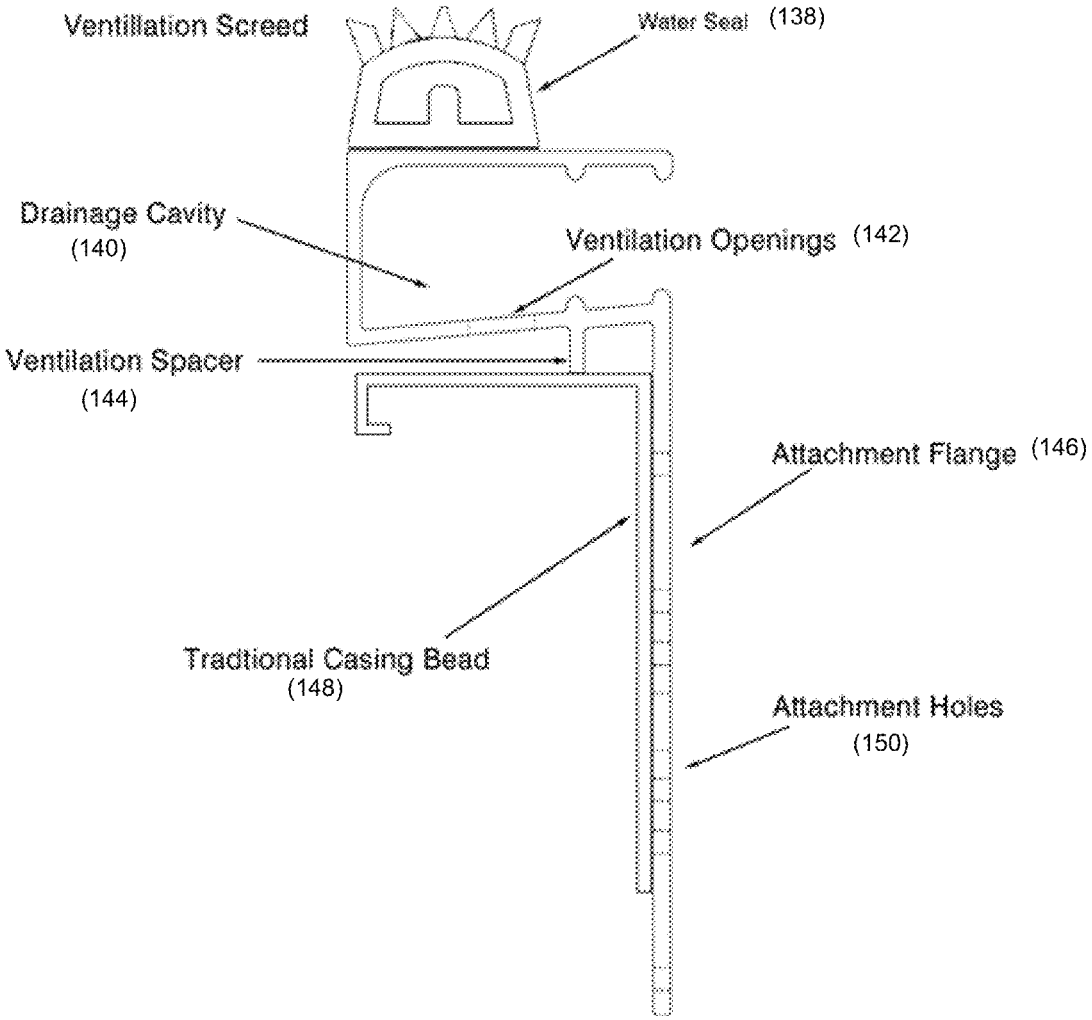
FIG. 7 depicts a side view of the present invention using a water seal with labeling.
Figure 8:
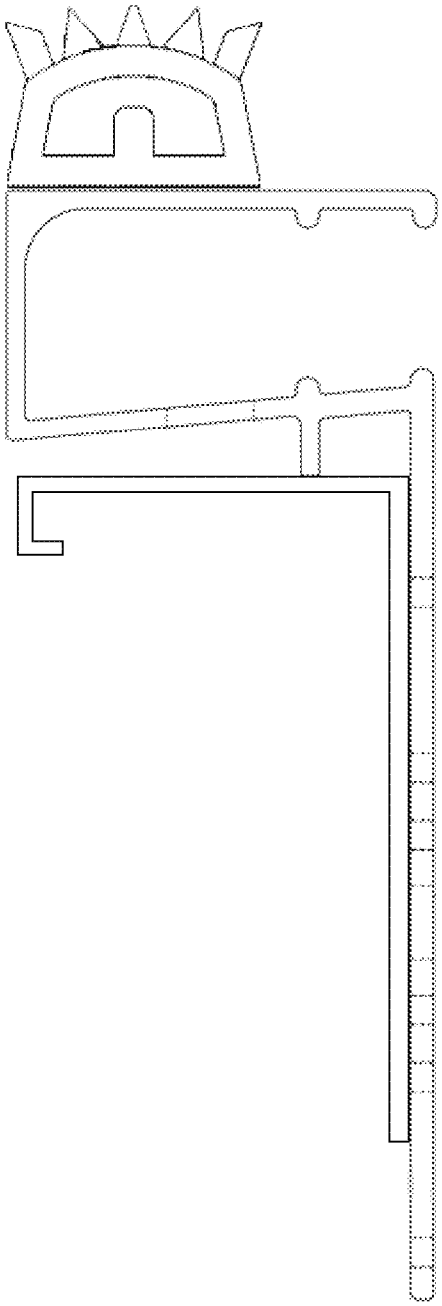
FIG. 8 depicts a side view of the present invention using a water seal without labeling.
Figure 9:
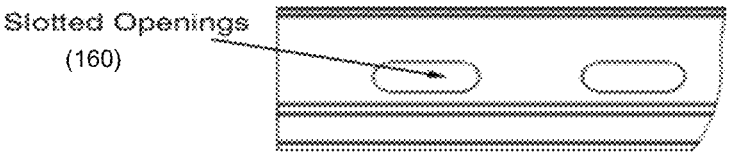
FIG. 9 depicts a front view of the present invention depicting a slotted opening with labeling.
Figure 10:
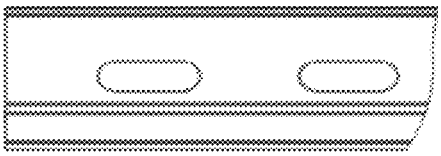
FIG. 10 depicts a front view of the present invention depicting a slotted opening without labels.

FIG. 4 depicts the present invention as installed in relation to a traditional casing bead (128). There is a ventilation screed (118) having a drainage cavity (120) and ventilation openings (122), a ventilation spacer (124), an attachment flange (126) with attachment holes (130). According to one aspect of the present invention, a ventilation screed assembly is provided. This is to say multiple ventilation screeds installed on a wall that are connected by the connector. The invention is a device configured to allow ventilation and the escape of water or other moisture in the form of vapor at the top of a building or structure wall. The various embodiments of this invention create a path for ventilation and drying of walls from the inside out. One preferred embodiment includes a perforated drainage cavity within the lower piece of the ventilation screed allowing the path for moisture and vapor to move up and out of the wall following a primary drainage plane such as a rainscreen. Another embodiment includes a spacer stop to maintain a consistent opening for ventilation between the drainage cavity formed by the ventilation screed and the optional, additional mechanism to terminate the stucco or other cladding material, e.g., a standard casing bead. Another embodiment includes a moisture seal, e.g., a gasket, at the juncture of vertical and horizontal surfaces such as a soffit. FIG. 6 depicts examples of gaskets (132, 136 and 136). Depending upon the rigidity of the water seal, the water seal provides water resistance and can allow minimal movement of the cladding of the wall. The device can be used for any exterior walls, but is not limited to use, in stucco systems, manufactured stone, and continuous rigid thermal insulation over the structure's wall substrate of the buildings wall design. The present invention overcome the problems of moisture escaping from the top of a wall as will be apparent to those skilled in the art of building cladding. As vapor is accumulated within a wall the flow of vapor can move by gravity or convection created by temperature, pressure or intrusion from outside the wall system. As temperature or pressure causes vapor to move to the top of the wall, this invention allows moisture and vapor to escape. Traditionally a casing bead has been used to terminate stucco at the top of a wall. Using just a casing bead, however, does not permit ventilation or drying of the wall. According to one embodiment an attachment flange with openings for nailing or other attachment means is provided. In one embodiment conjoined with a standard casing bead the termination of stucco and the ventilation of the wall can be accomplished. According to another embodiment a semi-rigid gasket with multiple shaped protuberances on top of the ventilation screed provides a snug and water resistant juncture of the invention and adjoining surfaces such as a soffit. According to another embodiment a flexible gasket with multiple shaped protuberances on top of the ventilation screed provides a water resistant juncture and allows minimal movement applied to the stucco panel or other cladding through lateral and compressive stresses. By introducing a primary drainage plane such as a rainscreen, vapor and moisture can rise and escape from behind the attachment flange through the drainage cavity through a plurality of openings in the bottom of the drainage cavity. Vapor and moisture will ultimately escape out through the space created with a standard casing bead. Another embodiment utilizes an extended edge on the lower surface of the drainage cavity to create a surface for a traditional casing bead to seat providing a consistent space for vapor and moisture to escape. Embodiments of this invention also allow for construction practices where the rain screen extends up into the soffit area for further exhausting of vapor and moisture to escape through to the plenum and ultimately to release through a roof vent. Embodiments of this invention can be incorporated into new construction or the remediation of worn or deficient walls of stucco, manufactured stone or continuous insulation. FIG. 1 depicts a perspective of the device with a ventilation screed and an attachment flange with nailing holes that is vertical to the building wall. FIG. 1 illustrates this embodiment is perforated with openings for the attachment with a code approved mechanical fastener and for the keying of finish, which may be cementitious or acrylic in nature. FIG. 1 depicts an embodiment that is attached on top of and through rainscreen, sheathing and water resistant barrier at the top of wall directly under the soffit. Pressing the Water Seal snugly and compressing slightly to provide a water resistant seal. During settling or loading of the structure the gasket will allow for minor movement. FIG. 1 depicts embodiment with "connector" accessory to facilitate the straight, true and continuous installation of this invention. FIG. 2 depicts the device in section in a basic preferred embodiment. FIG. 4 depicts an embodiment with a standard casing bead attached directly below and touching the extended spacer edge creating the exterior opening of the wall. The casing bead provides an additional smooth edge stop for the stucco finish. FIG. 7 depicts multiple sections of an embodiment for a one-piece, semi-rigid or a flexible plastic, polymer or other non-metallic gasket. The gasket may have a self-stick adhesive surface. As shown the ventilation screen has a drainage cavity (140), ventilation openings (142), ventilation spacer (144), moisture seal (138), attachment flange (146), attachment holes (150) and a traditional casing bead (148). Note the term moisture seal and water seal refer to the same thing which may be a gasket. The ventilation spacer maintains a more consistently defined space for vapor and moisture to escape the building. FIGS. 9 and 10 depict the slotted openings in the base of the drainage cavity. The present invention can be fabricated from a plurality of materials with consideration given to the specific requirements for different building envelope systems and construction practices. The present invention can be made of plastic, polymer or other non-metallic material, resistant to rusting and deterioration in moisture and salt or caustic environments as well as metal materials, metal alloy materials or composite materials. The present invention can address the unique needs and considerations for framed/sheathed walls, masonry and concrete masonry unit assemblies that can incorporate exterior finishes over a lathing substrate; manufactured stone over lathing substrate, various thicknesses of continuous thermal exterior insulation; wood or manmade siding; and metal panels both with and without insulation. The present invention is intended to be compatible with all types of substrates and materials e.g., carbon steel, stainless, non-metallic expanded metal, woven wire, welded wire and non-metallic lath. This device may be factory or job fitted to any type of stucco casing bead or to create a control joint with back to back casing beads. No control joint is available when the two adjacent stucco panels are of a different thickness.

As the invention has been described, it will be apparent to those skilled in the art that the same may be varied in many ways without departing from the spirit and scope of the invention. Any and all such modifications are intended to be included within the scope of the appended claims.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

The invention claimed is:

1. A ventilation screed configured to be mounted at a vertical wall of a structure, the ventilation screed comprising:

an attachment flange having an upper end region and a lower end region opposite the upper end region;

a cavity structure disposed along the upper end region of the attachment flange, the cavity structure having a first side, a second side, and a third side, wherein (i) the first side extends from the upper end region of the attachment flange, (ii) the third side extends over the first side and is spaced from the first side and from the upper end region of the attachment flange, and (iii) the second side extends between the first side and the third side;

wherein at least one ventilation opening is formed through the first side of the cavity structure;

wherein a ventilation spacer extends from the first side of the cavity structure and is spaced from and extends partially along the attachment flange;

wherein, with the ventilation screed mounted at the vertical wall of the structure, the third side comprises an uppermost surface of the ventilation screed; and wherein the cavity structure comprises a pap between the upper end region of the attachment flan e and an end of the third side that is distal from the second side.

2. The ventilation screed of claim 1, wherein the third side is perpendicular to a plane of the attachment flange, and wherein the second side extends along a plane that is parallel to the plane of the attachment flange and perpendicular to the third side.

3. The ventilation screed of claim 1, wherein the first side extends from the upper end region of the attachment flange along a plane that is at an oblique angle relative to a plane of the attachment flange.

4. The ventilation screed of claim 1, wherein the first side comprises a distal end distal from the attachment flange, the second side comprises a first end joined with the distal end of the first side and a second end distal from the first end, and the third side comprises a first end joined with the second end of the second side and a second end distal from the first end of the third side.

5. The ventilation screed of claim 4, wherein the ventilation spacer extends from the first side of the cavity structure at a position between the attachment flange and the distal end of the first side.

6. The ventilation screed of claim 4, wherein the second end of the third side is spaced from the upper end region of the attachment flange.

7. The ventilation screed of claim 6, wherein the gap is between the second end of the third side and the upper end region of the attachment flange, and wherein the gap between the second end of the third side and the upper end region of the attachment flange comprises an opening entirely along the cavity structure that is devoid of any structure connecting between the third side and the attachment flange.

8. The ventilation screed of claim 1, wherein the ventilation spacer extends from the first side of the cavity structure at a position between the attachment flange and the at least one ventilation opening.

9. The ventilation screed of claim 1, wherein the at least one ventilation opening comprises a plurality of ventilation openings spaced apart along the first side of the cavity structure.

10. The ventilation screed of claim 1, wherein the third side extends from the second side toward a plane of the attachment flange, and wherein the third side does not extend beyond the plane of the attachment flange.

11. The ventilation screed of claim 1, wherein the attachment flange comprises at least one aperture formed through the attachment flange.

12. The ventilation screed of claim 11, wherein the at least one aperture of the attachment flange comprises a plurality of rows of apertures.

13. The ventilation screed of claim 1, further comprising a sealing element disposed along an upper surface of the third side of the cavity structure.

14. The ventilation screed of claim 1, wherein the ventilation spacer is configured to, with the ventilation screed mounted at the vertical wall of the structure, engage an upper surface of a casing bead disposed at the vertical wall of the structure so that the cavity structure is spaced from the upper surface of the casing bead by the ventilation spacer.

15. The ventilation screed of claim 1, wherein the ventilation screed is configured to be connected to a second ventilation screed via a connector, and wherein the connector is partially received in the cavity structure of the ventilation screed and partially received in a second cavity structure of the second ventilation screed to connect the ventilation screed and the second ventilation screed.

16. The ventilation screed of claim 15, wherein the connector comprises a three sided connector corresponding to the cavity structure.

17. A ventilation screed assembly configured to be mounted at a vertical wall of a structure, the ventilation screed assembly comprising:

at least two ventilation screeds, each ventilation screed of the at least two ventilation screeds comprising (i) an attachment flange having an upper end region and a lower end region opposite the upper end region, and (ii) a cavity structure disposed along the upper end region of the attachment flange, the cavity structure having a first side, a second side, and a third side, wherein (i) the first side extends from the upper end region of the attachment flange, (ii) the third side extends over the first side and is spaced from the first side and from the upper end region of the attachment flange, and (iii) the second side extends between the first side and the third side;

a connector connecting adjacent ventilation screeds of the at least two ventilation screeds, the connector comprising a three sided connector corresponding to the cavity structure;

wherein the connector is partially received in the cavity structure of each of the adjacent ventilation screeds to connect the adjacent ventilation screeds;

wherein, with the ventilation screed assembly mounted at the vertical wall of the structure, each third side of the at least two ventilation screeds comprises an uppermost surface of the respective ventilation screed; and wherein each cavity structure of the at least two ventilation screeds comprises a gap between the upper end re ion of the attachment flange and an end of the third side that is distal from the second side.

18. The ventilation screed assembly of claim 17, wherein each ventilation screed of the at least two ventilation screeds comprises at least one ventilation opening formed through the first side of the cavity structure.

19. The ventilation screed assembly of claim 17, wherein each ventilation screed of the at least two ventilation screeds comprises a ventilation spacer extending from the first side of the cavity structure and spaced from and extending partially along the attachment flange.

20. The ventilation screed assembly of claim 17, wherein the gap of each ventilation screed of the at least two ventilations screeds comprises an opening entirely along the cavity structure that is devoid of any structure connecting between the third side and the attachment flange.

21. The ventilation screed assembly of claim 17, further comprising a sealing element disposed along an upper surface of the third side of the cavity structure of each ventilation screed of the at least two ventilation screeds.

22. A ventilation system for moisture ventilation at an upper edge region of a vertical wall of a structure, the ventilation system comprising:

a drainage element disposed along a base layer of a vertical wall of a structure;

a ventilation screed disposed outboard of the drainage element along an upper edge region of the vertical wall, the ventilation screed comprising an attachment flange, a drainage cavity structure, and a ventilation spacer;

wherein the drainage cavity structure comprises an uppermost surface of the ventilation screed;

wherein the drainage cavity structure comprises a gap between an upper end region of the attachment flange and an end of the uppermost surface of the ventilation screed; and a casing bead disposed at an outboard side of the attachment flange of the ventilation screed, wherein the casing bead engages the ventilation spacer of the ventilation screed and is spaced from the drainage cavity structure by the ventilation spacer, the casing bead configured to receive a finishing material of the vertical wall.

23. The ventilation system of claim 22, wherein the drainage cavity structure of the ventilation screed comprises at least one opening through a portion of the drainage cavity structure.

24. The ventilation system of claim 23, wherein the ventilation spacer is disposed at the portion of the drainage cavity structure between the at least one opening and the attachment flange.

25. The ventilation system of claim 23, wherein the portion of the drainage cavity structure comprises a lower side of the drainage cavity structure, and wherein the lower side of the drainage cavity structure is at an oblique angle relative to the attachment flange and slopes downward away from the attachment flange and the vertical wall.

26. The ventilation system of claim 22, wherein the drainage cavity structure extends from the upper edge region of the attachment flange.

27. The ventilation system of claim 22, wherein a sealing element is disposed at an upper side of the drainage cavity structure of the ventilation screed.

28. The ventilation system of claim 22, wherein the drainage element comprises a rain screen.

29. The ventilation system of claim 22, wherein the finishing material comprises at least one selected from the group consisting of (i) stucco, (ii) plaster, (iii) lath, (iv) siding, and (v) veneer.

* * * * *